US007901105B2

(12) United States Patent
Fowler, Jr. et al.

(10) Patent No.: US 7,901,105 B2
(45) Date of Patent: Mar. 8, 2011

(54) LIGHTING DEVICE AND LENS ASSEMBLY

(75) Inventors: Wilton L. Fowler, Jr., Easley, SC (US); Martin C. Werr, Easley, SC (US); Randy K. Lewis, Spartanburg, SC (US)

(73) Assignee: Hubbell Incorporated, Shelton, CT (US)

( * ) Notice: Subject to any disclaimer, the term of this patent is extended or adjusted under 35 U.S.C. 154(b) by 258 days.

(21) Appl. No.: 12/201,640

(22) Filed: Aug. 29, 2008

(65) Prior Publication Data

US 2010/0053947 A1 Mar. 4, 2010

(51) Int. Cl.
*F21V 21/00* (2006.01)

(52) U.S. Cl. ..... 362/217.15; 362/222; 362/224; 362/455

(58) Field of Classification Search ..... 362/217.01, 362/217.08, 217.15, 222–224, 455
See application file for complete search history.

(56) References Cited

U.S. PATENT DOCUMENTS

| | | | |
|---|---|---|---|
| 2,323,073 | A | 12/1940 | Netting |
| 3,132,813 | A | 5/1964 | Izzi et al. |
| 3,209,142 | A | 9/1965 | Michel et al. |
| 4,277,820 | A | 7/1981 | Bostonian |
| 5,865,528 | A | 2/1999 | Compton et al. |
| 5,950,340 | A | 9/1999 | Woo |
| 5,967,648 | A | 10/1999 | Barnes, II et al. |
| 5,988,829 | A | 11/1999 | Holder |
| 6,273,594 | B1 | 8/2001 | Ikeda et al. |
| 6,280,052 | B1 | 8/2001 | White |
| 6,644,830 | B2 | 11/2003 | Lewis et al. |
| D496,121 | S | 9/2004 | Santoro |
| 7,229,192 | B2 | 6/2007 | Mayfield, III et al. |
| 7,261,435 | B2 | 8/2007 | Gould et al. |
| 7,296,910 | B2 | 11/2007 | Mayfield, III et al. |
| D561,383 | S | 2/2008 | Hukle et al. |
| D561,930 | S | 2/2008 | Hukle et al. |
| D593,246 | S | 5/2009 | Fowler, Jr. et al. |
| D603,998 | S | 11/2009 | Fowler, Jr. et al. |
| D603,999 | S | 11/2009 | Fowler, Jr. et al. |
| D604,000 | S | 11/2009 | Fowler, Jr. et al. |
| D604,446 | S | 11/2009 | Fowler, Jr. et al. |
| 2007/0133215 | A1 | 6/2007 | Mayfield, III et al. |
| 2007/0211457 | A1 | 9/2007 | Mayfield, III et al. |
| 2007/0291418 | A1 | 12/2007 | Gould et al. |
| 2008/0019126 | A1 | 1/2008 | Straton et al. |

FOREIGN PATENT DOCUMENTS

| | | |
|---|---|---|
| GB | 362189 | 12/1930 |

*Primary Examiner* — Stephen F Husar
(74) *Attorney, Agent, or Firm* — Garrett V. Davis; Mark S. Bicks; Alfred N. Goodman

(57) ABSTRACT

A lighting assembly is provided having a main housing and a lens assembly hinged to the main housing. The lens assembly has a body with end walls with a recess in an upper end of the end walls. The recess in each end wall has a dimension to receive and support a lens for directing light to the target area. The lens has a length greater than the length of the cover so that the ends of the lens extend beyond the outer edge of the end walls of the cover. Stop members are provided on the end walls to limit longitudinal movements of the lens with respect to the body of the lens assembly. A reflector extends from a bottom edge of the cover to an upper edge overlying a portion of the lens. A spring clip is provided to couple the lens to the reflector.

34 Claims, 12 Drawing Sheets

LIGHTING DEVICE AND LENS ASSEMBLY

FIELD OF THE INVENTION

The present invention is directed to a troffer or lighting fixture having a lens cover assembly. The invention is particularly directed to a lighting fixture having a lens cover assembly with a lens and a reflector where the cover assembly is hinged to a main housing and the lens and reflector are coupled to opposed end walls.

BACKGROUND OF THE INVENTION

Numerous lighting fixtures for directly illuminating areas are known. A common lighting assembly used in commercial buildings includes a troffer with one or more fluorescent lamps mounted therein. The lighting fixture can have a removable grid attached to the housing to allow access to the lamps for replacement. The reflectors are generally mounted to the housing. Other forms of lighting assemblies include a hinged or removable cover having a reflector and a lens that cooperate with the lamp in the closed position. The lamps are positioned inside the lens and the reflector is spaced from the lens to direct the light to the selected area to be illuminated.

Lighting assemblies are constructed to provide various needs and address certain lighting problems. The lighting assembly attempts to balance the required illumination of horizontal surfaces and vertical surfaces to provide the desired light quality. Difficulties often occur in smaller areas to avoid shadows or bright spots.

The lighting assemblies can use various lamp shapes and designs. The fluorescent lamp has been used frequently for many years. The fluorescent lamps are available in various sizes depending on the size of the lighting assembly. A disadvantage of many conventional fluorescent lamps is the brightness and glare which can be objectionable when viewed directly. These lighting assemblies often include opaque shielding or lenses to cover the lamp. The lens often includes prisms to diffuse the light and soften the glare. Various efforts have been made to provide lenses and shielding to reduce the brightness and glare of the fluorescent lamp. Examples of this form of lighting assembly are found in U.S. Pat. No. 5,988,829 to Holder, U.S. Pat. No. 7,229,192 to Mayfield et al., U.S. Pat. No. 6,280,052 to White and U.S. Pat. No. 7,261,435 to Gould et al.

Another example of a light fixture is disclosed in U.S. Pat. No. 7,296,910 to Mayfield et al. This light fixture includes a housing having a mounting assembly for the light and reflectors mounted on each side of the light and attached to the housing. A lens is hooked to the reflector around the light. The lens is removable from the reflector and the housing to access the light.'

U.S. Published Patent Application No. 2007/0211457 to Mayfield discloses a replacement light fixture and lens assembly. The lens assembly can have a lens that hooks onto the ends of a reflector. The lens can also be mounted as a single piece with portions being painted to form reflector areas around a transparent lens portion.

While the prior lighting assemblies have generally been successful for the intended purpose, there is a continuing need in the industry for improved lighting assemblies.

SUMMARY OF THE INVENTION

The present invention is directed to a troffer or lighting fixture assembly for mounting to a ceiling. More particularly, the invention is directed to a lighting fixture having a cover or door in the form of a lens assembly hinged to the main housing of the lighting fixture where the cover includes at least one lens, at least one reflector, and a pair of opposed end walls.

The lighting assembly of the invention includes a main housing which supports the lamp and electrical components and a hinged cover and lens assembly connected to the housing. The cover formed by the lens assembly includes at least one reflector and a lens. The lens is positioned to overlie the lamp when the cover is in the closed position. The reflector is positioned adjacent the lens to reflect light passing through the lens in the desired direction.

One aspect of the invention is to provide a lighting assembly that is easy to construct and assemble. The lighting assembly preferably has a removable cover that includes a reflector and lens assembly and two opposed end walls, without the need for additional structural members or a large number of fasteners. Preferably, the lighting assembly is constructed to prevent light leakage from the housing to minimize shadows and glare.

Another aspect of the invention is to provide a cover for the lighting assembly where the reflector, lens and end walls form the lens assembly and the cover which can allow access to the lamp when the cover is in the open position. The cover is hinged to the housing and is latched in the closed position.

A further aspect of the invention is to provide a lighting assembly having a cover where the reflector and lens are secured directly to the cover for allowing easy access to the lamp and electrical components.

Another aspect of the invention is to provide a lens assembly for a lighting assembly having a lens with a longitudinal length greater than the longitudinal length of the body such that the ends of the lens extend beyond the ends of the cover a predetermined distance. In one embodiment of the invention, the end walls of the lens assembly include tabs to prevent longitudinal movement of the lens with respect to the lens assembly.

The various aspects of the invention are obtained by a lens assembly for directing light emitted from a light source toward a designated area, the lens assembly comprising a body having a first end wall and an opposite second end wall. The first and second end walls have a bottom edge and a top edge with a recessed area. A lens has a longitudinal dimension and an outer configuration and outer dimension complementing said recessed area in said end walls. The lens is received in said recessed areas of the end walls.

The various aspects of the invention are also obtained by providing a light fixture for directing light toward a designated area, where the light fixture includes a body supporting a light source for emitting light and a lens assembly hinged to the body. The lens assembly comprises a body having a first end wall and an opposite second end wall. Each of the end walls have a bottom edge and a top edge, where each top edge has a recessed area. A lens has a longitudinal dimension and an outer configuration and dimension complementing the recessed area in the end walls. The lens is received in recessed areas and supported by the end walls.

The aspects of the invention are further obtained by providing a lighting assembly for directing light toward a designated area, where the assembly comprises a main housing supporting a lamp and lens assembly. The housing has opposite side walls and opposite end walls, with the lamp extending between the opposite end walls. The lens assembly is hinged to the housing. The lens assembly comprises a first end wall having a bottom edge and a top edge with a recessed area, a second end wall having a bottom edge and a top edge with a recessed area, and a lens having a longitudinal dimension with an open top end and being received in the recessed areas and supported by the end walls. A first reflector extends between and is coupled to the end walls. The first reflector has a top end coupled to a first edge of the top end of the lens. A second reflector extends between and is coupled to the end walls. The second reflector has a top end coupled to a second edge of the top end of the lens. The second reflector is positioned on a side of the lens opposite the first reflector.

Another aspect of the invention is to provide a lighting fixture and lens assembly for directing emitted light from a light source. The lens assembly comprises a first end wall and second end wall opposite the first end wall. A first reflector having a longitudinal dimension with a first end is coupled to the first end wall by a fastener and a second end is coupled to the second end wall by a fastener. A second reflector having a longitudinal dimension with a first end is coupled to the first end wall by a fastener and a second end is coupled to the second end wall by a fastener. The second reflector is spaced from the first reflector to form a longitudinal opening between the first and second reflectors. A lens having a longitudinal dimension greater than the longitudinal dimension of the first and second reflectors is received in the opening.

The aspects of the invention are also attained by providing a lens assembly kit. The kit includes a housing having a first end wall and an opposite end wall, a first reflector extending between the first and second end walls and a second reflector extending between the first and second end walls and being spaced apart to define a longitudinal opening. The kit includes a first lens having a dimension corresponding to the opening and having a first shape, and a second lens having a dimension corresponding to the opening and having a second shape that is different from the first shape.

These and other aspects of the invention will become apparent from the following detailed description of the invention which, in conjunction with the annexed drawings, disclose various embodiments of the invention.

BRIEF DESCRIPTION OF THE DRAWINGS

The following is a brief description of the drawings in which.

DETAILED DESCRIPTION OF THE INVENTION

The present invention is directed to a troffer or lighting assembly having a hinged cover and lens assembly. In particular, the invention is directed to a lighting assembly having a cover and lens assembly hinged to a main housing where a lens assembly includes a reflector and a lens and a pair of opposed end walls. The lens assembly of the invention has a minimum number of parts and fasteners.

Referring to FIGS. 1-11, a first embodiment of the invention is shown of the lighting assembly 10. Lighting assembly 10 includes a main housing 12 and a lens assembly 14 which defines a cover or door for enclosing the main housing 12.

Figure 2:
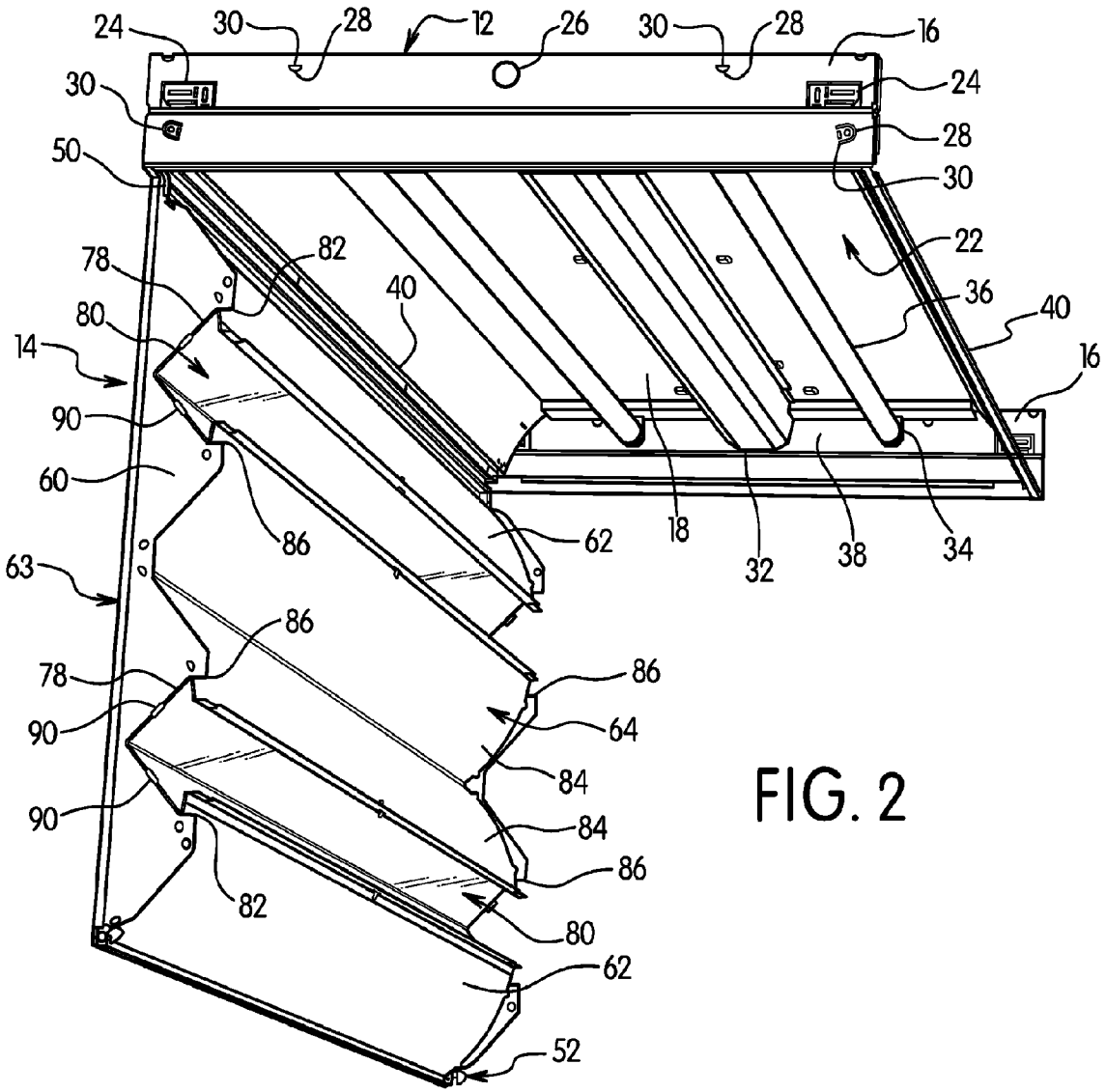
FIG. 2 is a bottom perspective view of the lighting assembly of FIG. 1 showing the lens assembly and cover in an open position.

Referring to FIG. 2, main housing 12 includes side panels 16 and top wall 18 and side walls 20. As shown in FIG. 2, side walls 20 have a slightly curved shape and are inclined with respect to top wall 18 to define an internal cavity 22 of main housing 12. Main housing 12 and its components are typically made of sheet metal that is cut and folded to the desired shape.

Side end panels 16 include mounting brackets 24 for mounting lighting assembly 10 to a ceiling or other support structure. Mounting brackets 24 are typically constructed to mount to a T-bar of a suspended ceiling as commonly used in building construction. At least one knock-out or pry-out plug 26 is provided in side end panel 16 for supplying electrical wiring to the lighting assembly.

In the embodiment illustrated, top wall 18 and side walls 20 are formed from a single sheet of metal that is bent and folded to enclose the top side of main housing 12. Top wall 18 and side walls 20 are provided with tabs 28 on the opposite ends of top walls 18 and side wall 20. Tabs 28 are inserted through slots 30 formed in side panels 16 and are bent over to secure the assembly together.

Figure 1:
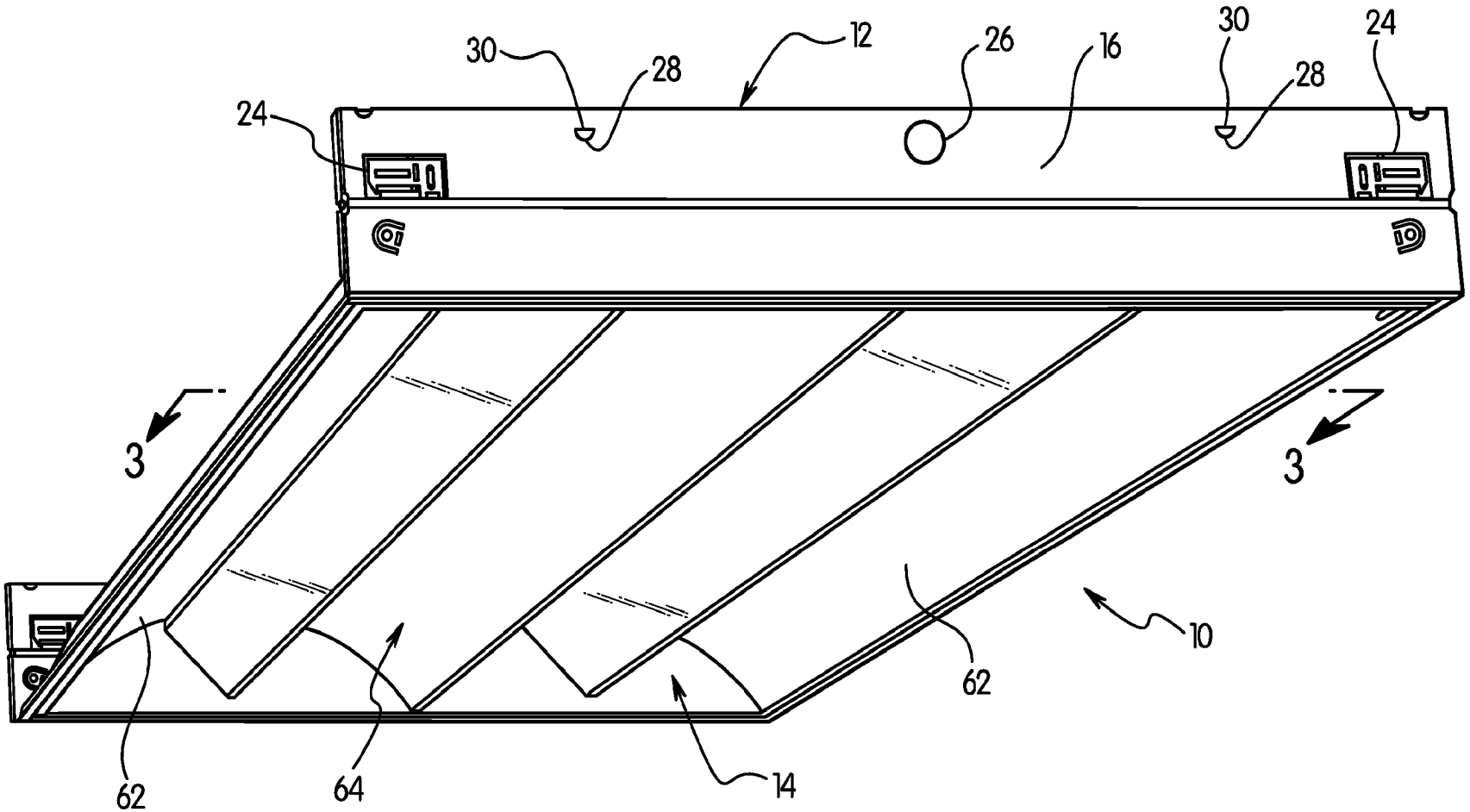
FIG. 1 is a bottom perspective view of the lighting assembly in a first embodiment of the invention.
Figure 3:
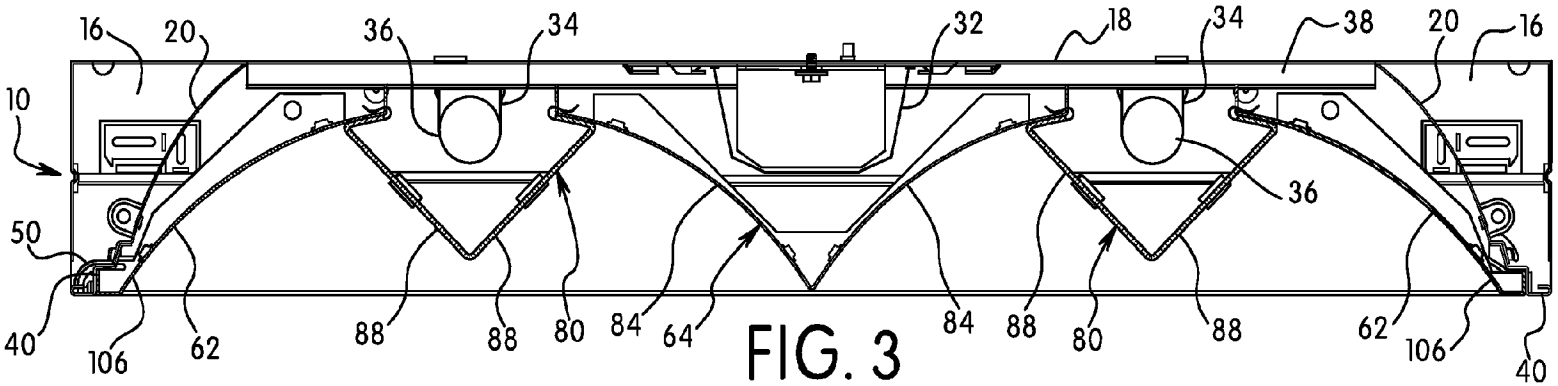
FIG. 3 is a cross-sectional view of the lighting assembly taken along line 3-3 of FIG. 1.

As shown in FIG. 2, top wall 18 has a bottom side facing internal cavity 22 and supporting a ballast cover 32 enclosing a ballast and wiring and lamp bases 34. Lamp bases or sockets 34 are provided on each end of top wall 18 to support a lamp 36. In the embodiment shown in FIGS. 1-8, a single lamp 36 is shown on opposite sides of ballast cover 32 and main housing 12. In other embodiments, more than one lamp can be provided depending on the desired lighting properties. Lamp 36 is shown as a single fluorescent tube although other lamp arrangements can be used. In the embodiment illustrated, a socket pan 38 is coupled to top wall 18 to define a channel for supplying electrical wiring from the ballast 32 to each lamp base 34. A bottom rail 40 extends between side panels 16 at a lower end of side walls 20 as shown in FIGS. 1 and 3. Bottom rails 40 are provided on each end of main housing 12 and secured to side end panels 16 and coupled to side walls 20.

Lens assembly 14 is coupled to main housing 12 in a manner to pivot between an opened and closed position shown in FIG. 2 to allow access to lamps 36 and the electrical components within main housing 12. Lens assembly 14 defines a cover or door assembly that is removably coupled to housing 12. Bottom rails 40 of main housing 12 include an aperture for receiving a hinge member 50 on lens assembly 14 to allow lens assembly 14 to pivot to an open position. Hinge member 50 in the embodiment illustrated is a hook-shaped member formed at opposite ends on one side of lens assembly 14. Hinge member 50 is inserted through the aperture in bottom rail 40 and slides within the aperture between an open and closed position. The opposite end of lens assembly includes a pair of latch members 52 which latch into a complimenting aperture in the corresponding bottom rail 40. Latch members 52 are pivotally connected to cover 14 by pivot pin 54. Latch 52 in the embodiment illustrated has a hook portion 56 and an operating tab 58. A spring is preferably provided to pivot latch 52 in a locking direction. Alternatively, a sliding latch can be provided to engage bottom rail 40 of main housing 12. Preferably, latch members 52 are provided at opposite corners of lens assembly 14.

Lens assembly 14 has a shape and dimension to fit within cavity 22 of main housing 12 and to form a cover or door to close the open bottom end of main housing 12. Lens assembly 14 includes opposite end walls 60, curved side reflectors 62 and a center reflector 64 which form a body 63 of lens assembly 14. End walls 60 are substantially mirror images of each other and have a bottom edge 66 formed with an upturned lip 68. End walls 60 are formed from a sheet material such as sheet metal that is cut and formed into a desired shape. Lip 68 is bent at right angles to form bottom edge 66. In the embodiment shown, lip 68 extends upwardly in a direction substantially parallel to the plane of end wall 60.

Figure 5:
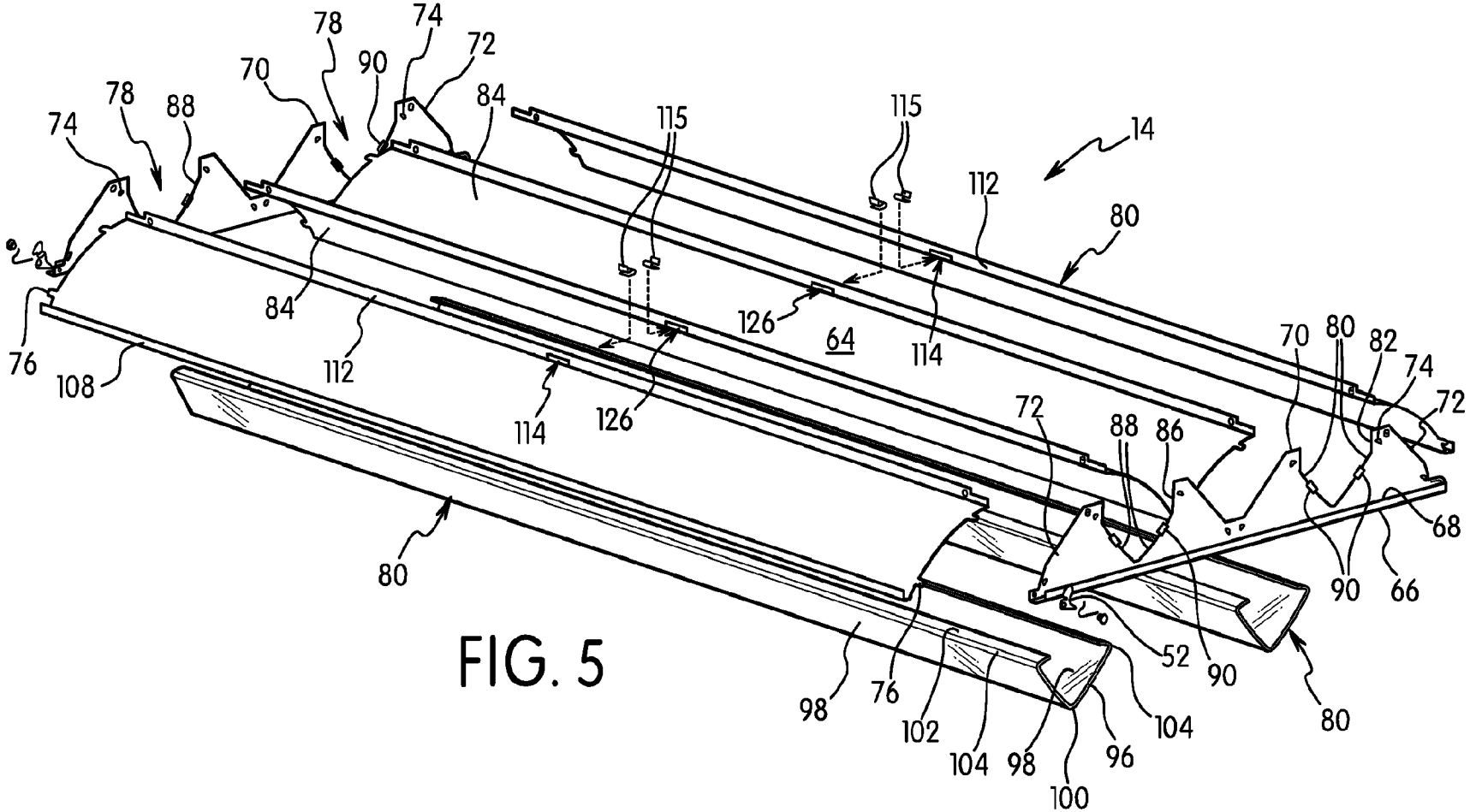
FIG. 5 is an exploded perspective view of the lens assembly.
Figure 7:
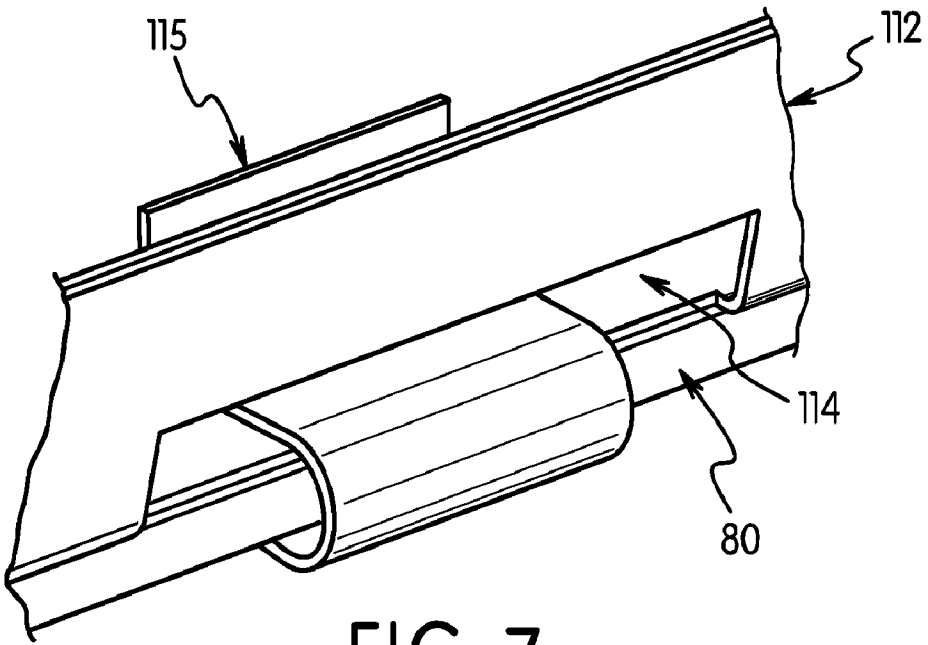
FIG. 7 is a partial perspective view of the clip coupling the lens to the reflector.
Figure 6:
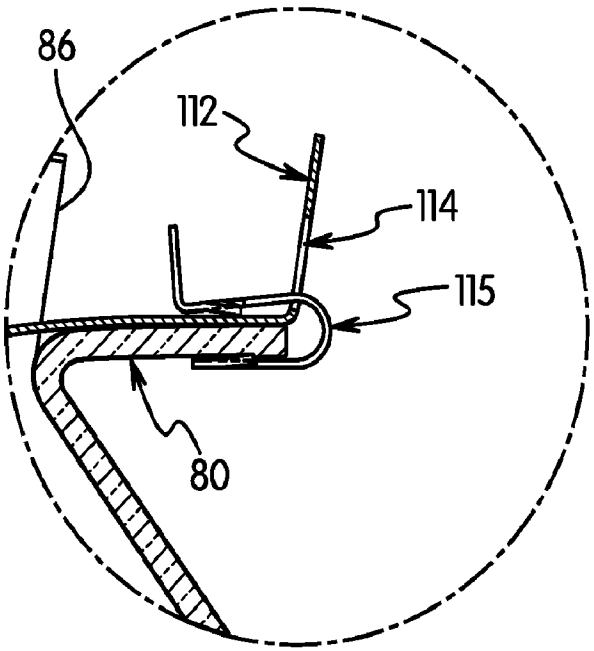
FIG. 6 is a partial enlarged cross-sectional view of the clip coupling the lens to the reflector.

End walls 60 have a top edge 70 and side edges 72. Side edges 72 in the embodiment shown are inclined with respect to the longitudinal dimension of lens assembly 14 so as to fit within the internal cavity 12 of main housing 22 as shown in FIG. 3. End wall 60 has a plurality of slots 74 which receive tabs 76 of the corresponding reflectors 62 and 64. The tabs 76 are inserted through the respected slots 74 and bent against the face of end wall 60 to attach the reflectors to the end walls. The tabs 76 can be spot welded as needed to secure the parts together. This arrangement enables the construction of the lens assembly with a minimum number of parts and fasteners while providing the necessary rigidity of the lens assembly. As shown in the embodiment of FIG. 5, two spaced-apart substantially V-shaped recess portions 78 are formed along the top edge 70 to receive a lens 80, which are also known as diffusers. The recessed portions 78 are shown as having a substantially V-shape, although the recessed portions can have other shapes or profiles. As discussed herein, the shape or profile of the recessed portions correspond to the shape or profile of the lens. Side reflectors 62 are coupled to end walls 60 and extend between bottom edge 66 and the upper outer edge 82 of the V-shaped recesses 78. Side reflectors 62 have a substantially curved shape with a concave downwardly facing surface. Center reflector 64 as shown in FIG. 3 has a substantially V-shape forming two curved reflector panels 84. The two reflector panels 84 converge to an apex adjacent bottom edge 64 of end walls. Each reflector panel 84 of center reflector 64 extends from bottom edge 66 to an upper inner edge 86 of each recess 78. In the embodiment illustrated, side reflectors 62 and reflector panels 84 have a slightly arcuate shape with a concave surface facing downwardly for reflecting light in a downward direction with respect to lighting assembly 10. In other embodiments, the reflectors can be a flat surface or multifaceted surface as desired. End walls 60 and reflectors 62 and 64 are preferably made of sheet metal. The assembled end walls and reflectors form a lens housing which also operate as a cover for the main housing of the body.

Figure 8:
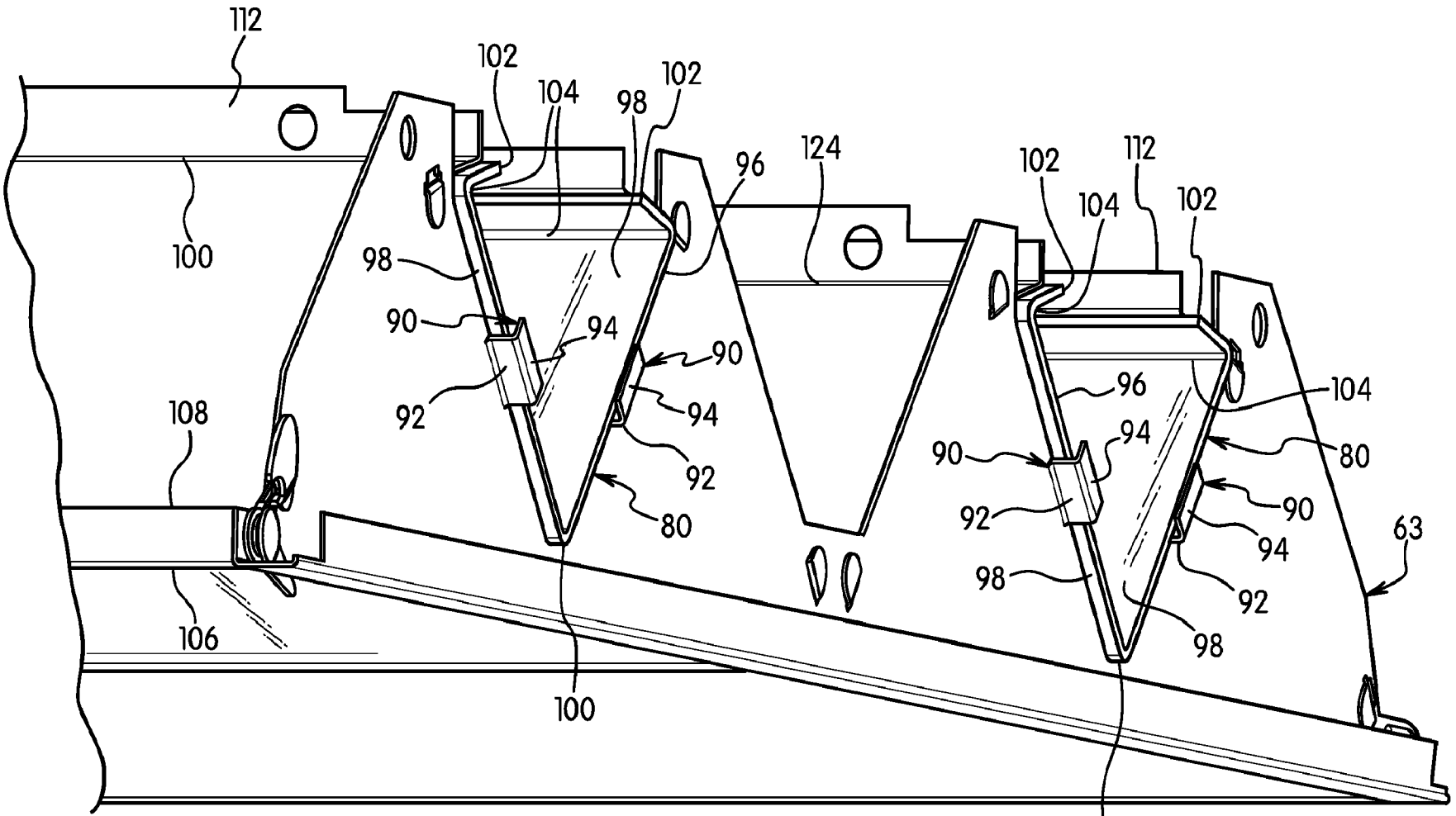
FIG. 8 is a perspective end view showing the lens coupled to the lens assembly.

Referring to FIG. 8, recess 78 in end walls 60 form a substantially V-shape with a pair of inclined edges 88 that converge downwardly toward bottom edge 66 and open upwardly to top edge 70. Each inclined edge 88 is provided with a stop member 90 to position lens 80 within the respective V-shaped recess 78 to limit longitudinal movement of lens 80. Stop member 90 in the embodiment illustrated is an L-shaped member having a first leg 92 extending substantially perpendicular to the plane of end wall 60 adjacent the inclined edge 88. A second leg 94 extends in a generally upward direction perpendicular to the plane of first leg and parallel to the plane of end wall 60. As shown in FIG. 8, second leg 94 extends inwardly with respect to V-shaped recess 78.

Figure 9:
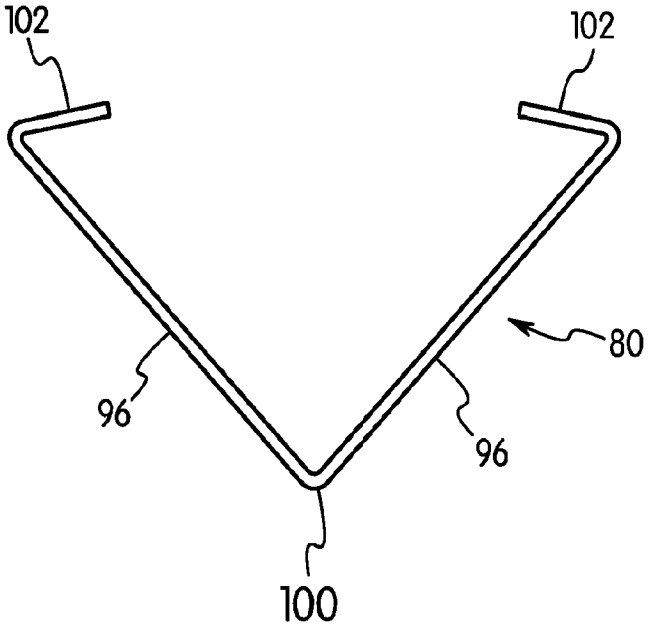
FIG. 9 is an end view of the lens of the embodiment of FIG. 1.

Each lens 80 has a shape complementing the shape and dimensions of recess 78. In the embodiment illustrated, lens 80 has a longitudinal length with a longitudinal end 96. Lens 80 is formed with two side panels 98 that converge to an apex 100 at a bottom end as shown in FIG. 9. An inwardly extending flange 102 extends inwardly from a top edge 104 of each of side panels 98.

Figure 4:
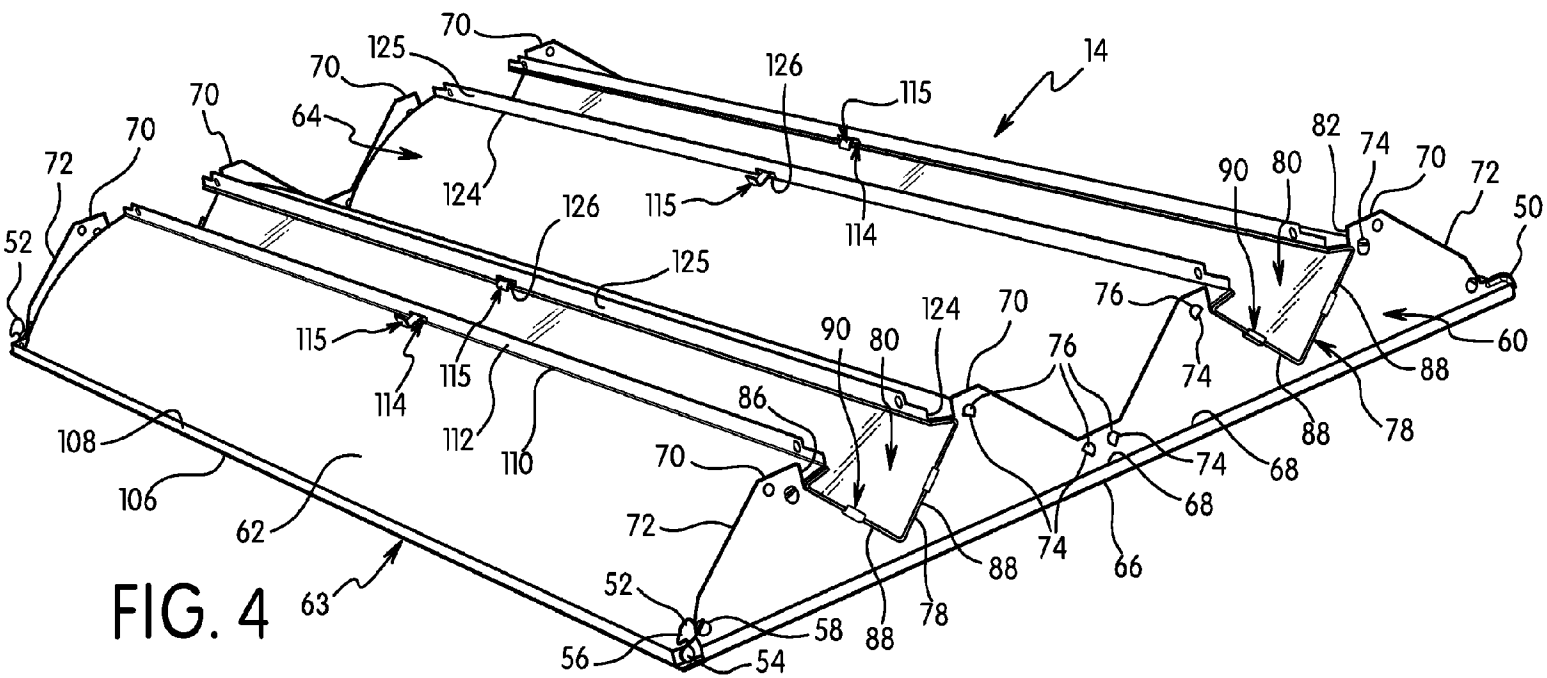
FIG. 4 is a top perspective view of the lens assembly removed from the lighting assembly.

As shown in FIGS. 3-5, each lens 80 is received within the respective recess 78 and has a longitudinal length greater than the spacing between the end walls 60. As shown in FIG. 5, the longitudinal ends 96 of lens 80 extend outwardly from the outer surface of end walls 60. Ends 96 of lens 80 are received within the L-shaped stop member 90 which resists longitudinal movement of lens 80 with respect to cover 14. Preferably, side panels 98 of lens 80 seat against the inclined edges 88 to minimize or eliminate light leakage.

As shown in FIGS. 2 and 3, the upper end of side reflectors 62 and center reflector 64 overly flanges 102 of the respective lens 80. Side reflectors 62 have a bottom edge 106 with an upturned lip 108. A top edge 110 of side reflectors 62 are preferably aligned with the inner edge of flange 102 of the respective lens. Upper edge 110 of side reflector includes an upturned lip 112 that extends upwardly substantially perpendicular to the main portion of side reflector 62.

Figure 10:
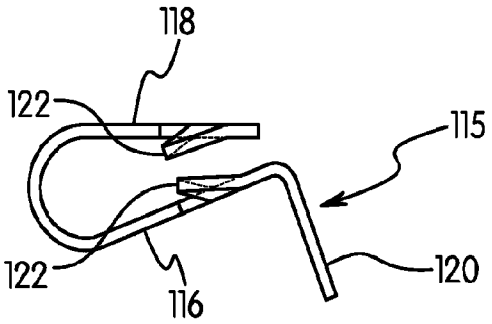
FIG. 10 is a side view of the clip connecting the lens to the reflector.
Figure 11:
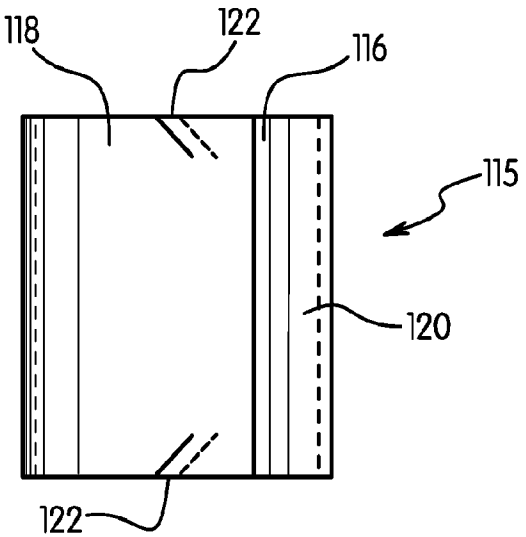
FIG. 11 is a top plan view of the clip of FIG. 7.

Each lip 112 has an aperture 114 for receiving a spring clip 116 for coupling lens 80 to reflectors 62. As shown in FIGS. 10 and 11, spring clip 114 has a first leg 116 and a second leg 118 that are spring biased toward each other. First leg 116 is provided with an operating tab 120 extending substantially perpendicular to first leg 116 for manipulating spring clip into and out of engagement with the reflector and lens. Locking teeth 122 are provided on the first leg 116 and second leg 118 for gripping the reflector and lens. First leg 116 is passed through aperture 114 and lip 112 so that the spring clip grip the outer edge of the respective reflector and the inner edge of the respective flange 102 of lens 80. As shown in FIGS. 3 and 5 center reflector 64 has a top edge 124 and upturned lip 125 with an aperture 126 for receiving a spring clip 115 and coupling the respective lens to the center reflector 64.

Lens 80 is typically made of a plastic material and is sufficiently rigid to prevent bending and twisting. Lens 80 can be clear, frosted or include prisms on an inner or outer surface as desired. Lighting assembly 10 is typically mounted to a ceiling or other support structure in a standard manner. Main housing 12 is typically mounted to the ceiling or T-bar support of a suspended ceiling and suitable wiring (not shown) is connected to the ballast and other electrical components in main housing 12. Lens assembly 14 is connected to main housing by hinge hooks 50 and pivoted to the closed position shown in FIG. 1. As shown in FIG. 2, each lens 80 is aligned with the respective lamp 36 so that light passes through the respective lens and is directed in a downward direction by the reflectors. Preferably, main housing 12 and cover 14 are constructed to minimize light leakage around the top and side edges so that substantially all of the light is reflected in a downward direction to the selected target area to be illuminated, with cover 14 being formed of a minimum number of parts, structural members and fasteners.

Figure 12:
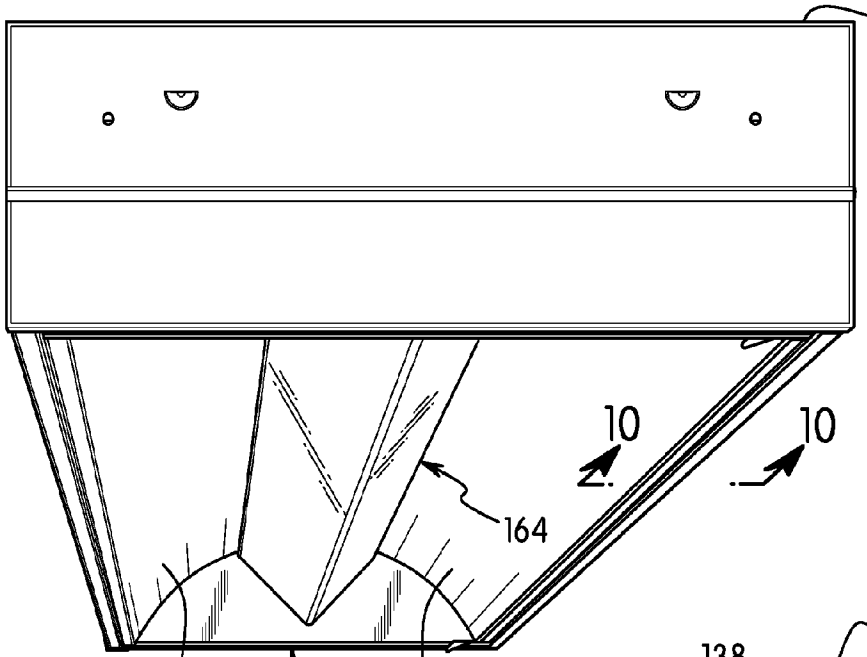
FIG. 12 is a perspective view of the lighting assembly in a second embodiment of the invention.
Figure 13:
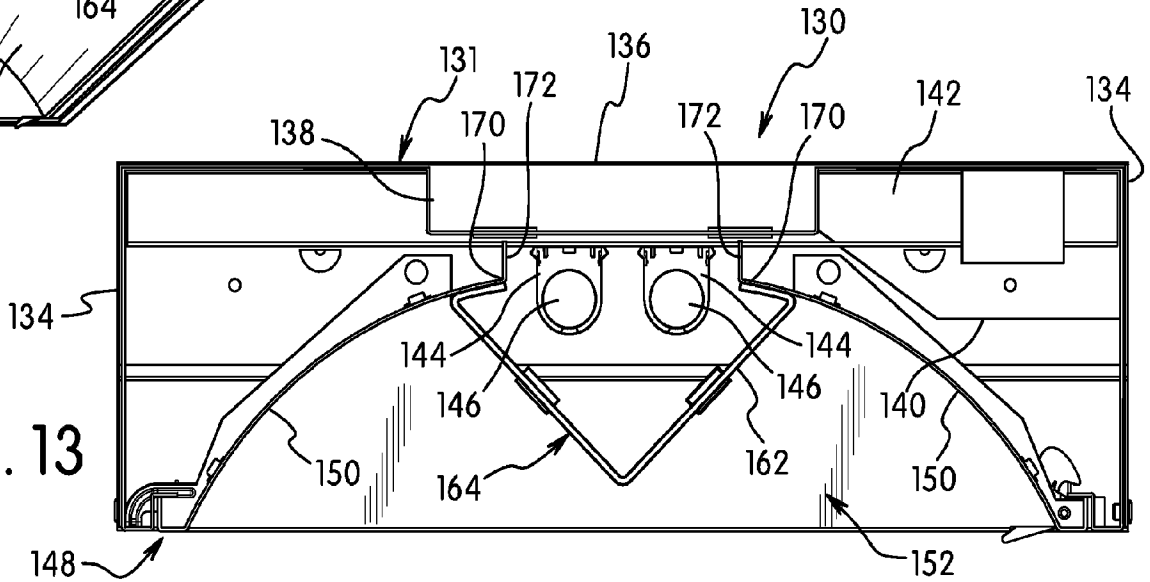
FIG. 13 is a cross-sectional view taken along line 10-10 of FIG. 9.
Figure 14:
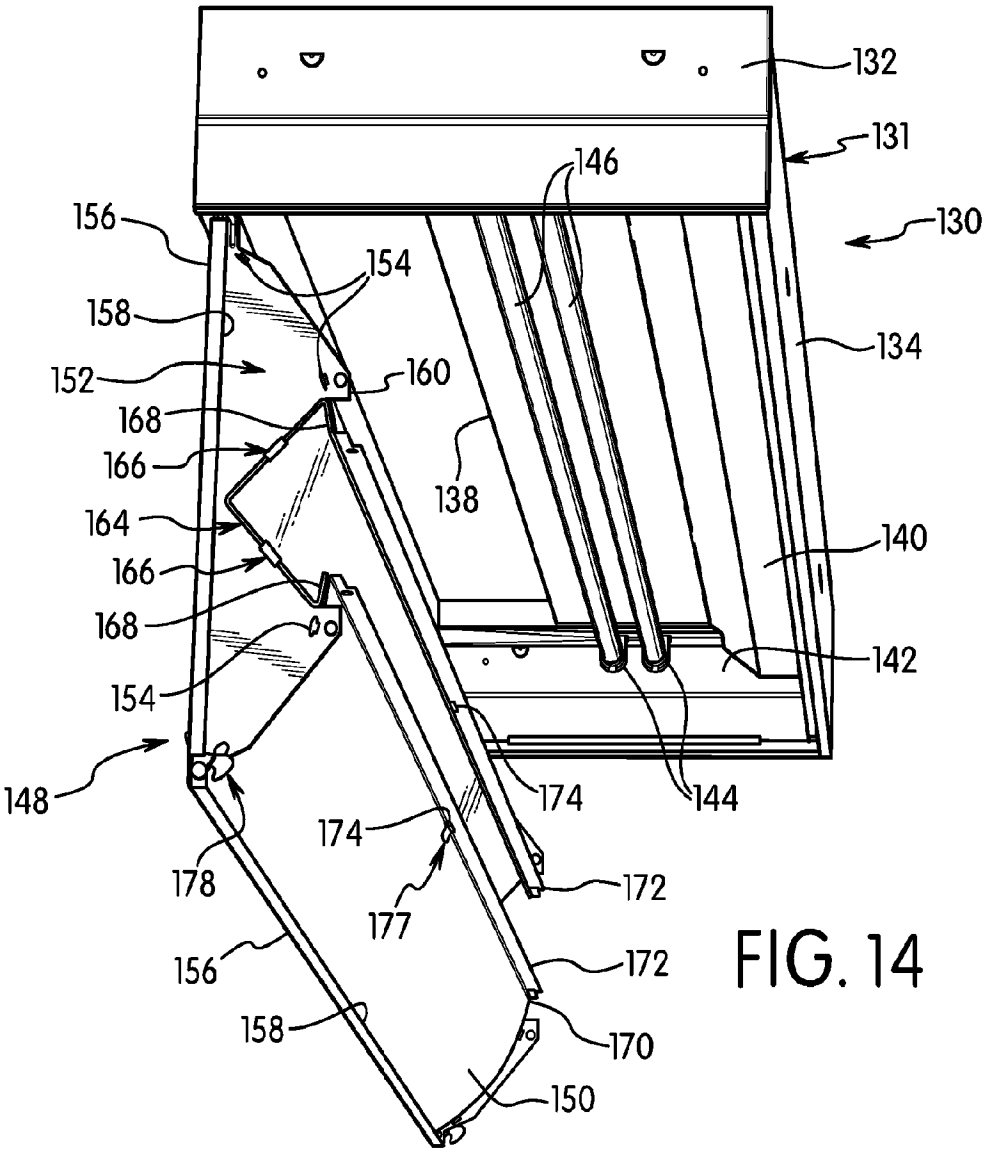
FIG. 14 is a perspective view of the lighting assembly of FIG. 9 showing the cover in the opened position.

Referring to FIGS. 12-14, a second embodiment in the invention is illustrated. This embodiment is similar to the embodiment of FIGS. 1-11. Lighting assembly 130 as shown in FIGS. 12 and 13 includes a main housing 131, end walls 132, side walls 134 and a top wall 136. A ballast cover 138 is attached to the inner surface of top wall 136 to enclose a ballast and electrical wiring. An electrical cover 140 extends between ballast cover 138 and side wall 134 to enclose electrical components. A socket pan 142 extends along each end wall 132 for supporting lamp base 144 and enclosing wiring supplied to each lamp base 144. In the embodiment illustrated, two lamp bases 144 are mounted adjacent each other for supporting two parallel lamps 146.

A lens assembly 148 is constructed in similar manner as the embodiment of FIGS. 1-11. Lens assembly 148 includes side reflectors 150 that are coupled to end walls 152 by tabs 154 that are inserted through a respective hole in end walls 152.

End walls 152 have a bottom edge 156 with an upturned lip 158. A top edge 160 of end walls 152 has a single recess 162 to receive a lens 164. The recess 162 in this embodiment has a substantially V-shape corresponding to the shape of the lens 164. End walls 152 include L-shaped stop members 166 adjacent recess 162 to limit longitudinal movement of lens 164 as in the previous embodiment.

Lens 64 has a substantially V-shape as in the previous embodiment with inwardly extending flanges 168. Side reflectors 150 have an upper edge 170 with a flange 172 extending in an upward direction. Flange 172 includes an aperture 174 for receiving a spring clip 177. Spring clip 177 is constructed substantially the same as in the previous embodiment.

Lighting assembly 130 is used in a similar manner by mounting the main housing in the ceiling. Cover 148 is connected to main housing 131 by hinge members to pivot from the closed position shown in FIGS. 9 and 10 to the opened position shown in FIG. 14. A latch member 178 is included to latch cover 148 in a closed position.

Figure 15:
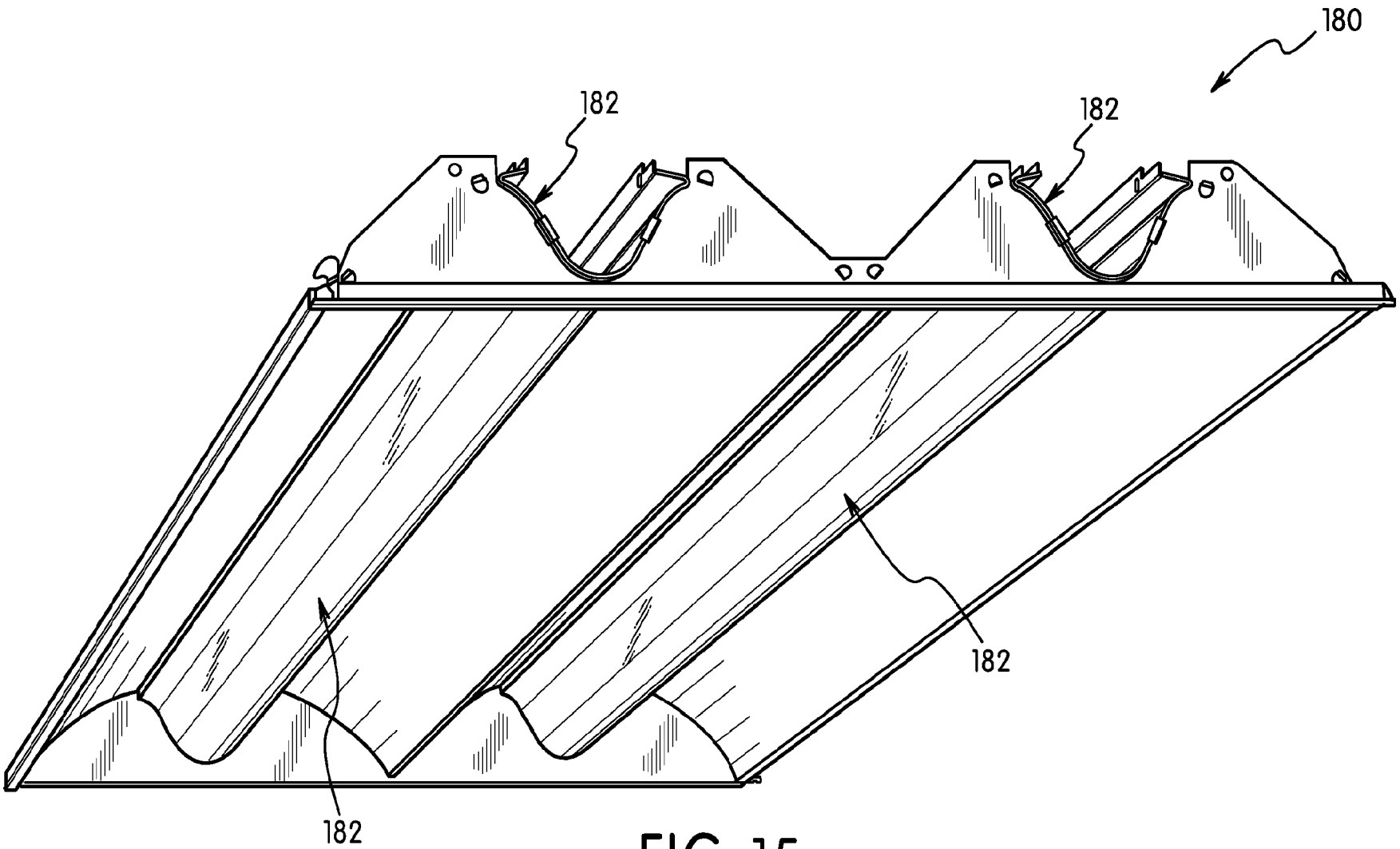
FIG. 15 is a perspective view of the lens assembly in a third embodiment of the invention.
Figure 16:
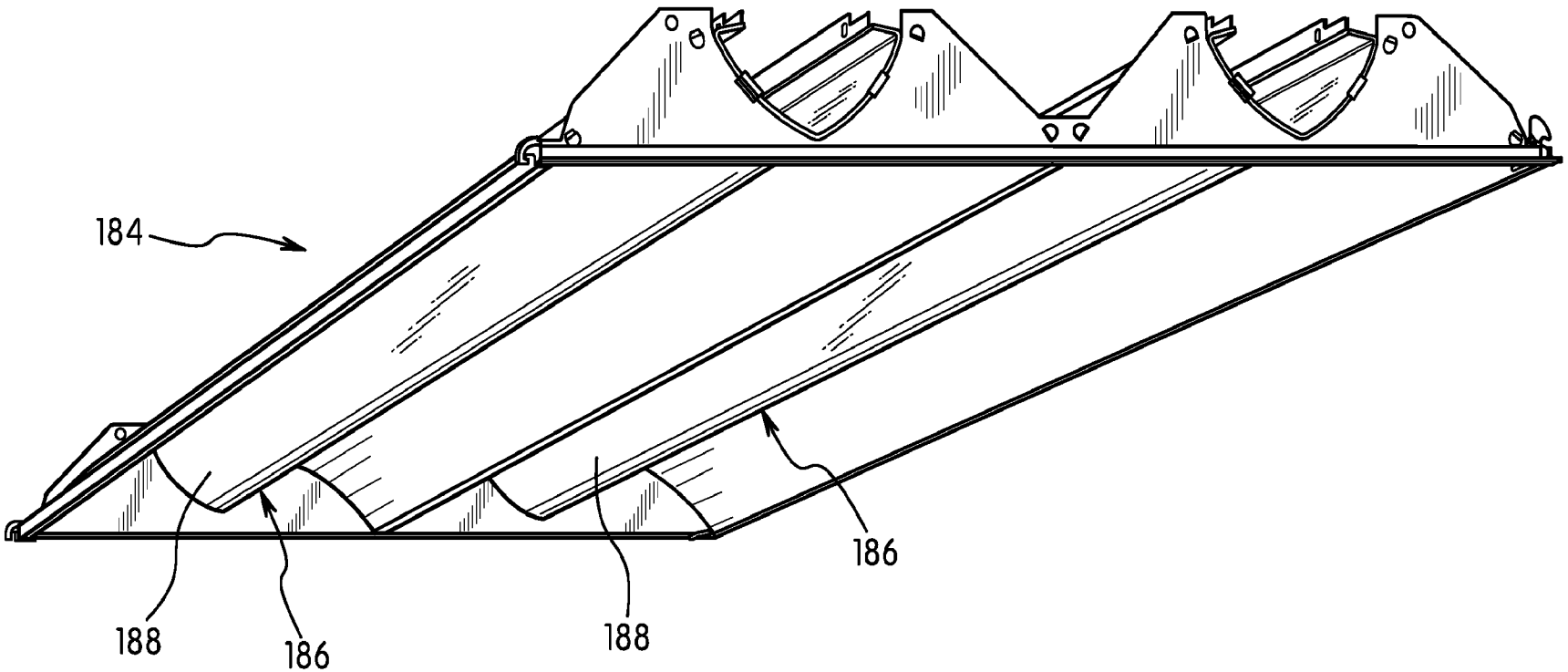
FIG. 16 is a perspective view of the lens assembly in a fourth embodiment of the invention.

In the embodiments illustrated, the lens is shown as having a substantially V-shape with flat side panels to form a generally triangular-shaped cross-section as shown in FIG. 9. In other embodiments, the lens can have various shapes and dimensions depending on the desired appearance of the lighting assembly. In an alternative embodiment shown in FIG. 15, a lens assembly 180 is provided with a lens 182 having a generally curved bell-shaped or concave-convex profile commonly referred to as a cyma-shape. Lens assembly 180 is constructed in a manner similar to the embodiment of FIGS. 1-11. It will be understood that other shapes and profiles of the lens can be used. A further embodiment is shown in FIG. 16. In this embodiment, lens assembly 184 has a lens 186 with curved side panels 188 which form a modified substantially V-shaped cross-section with convex outer profiles or surfaces. Lens assembly 184 is constructed in substantially the same manner as the previous embodiments.

Figure 17:
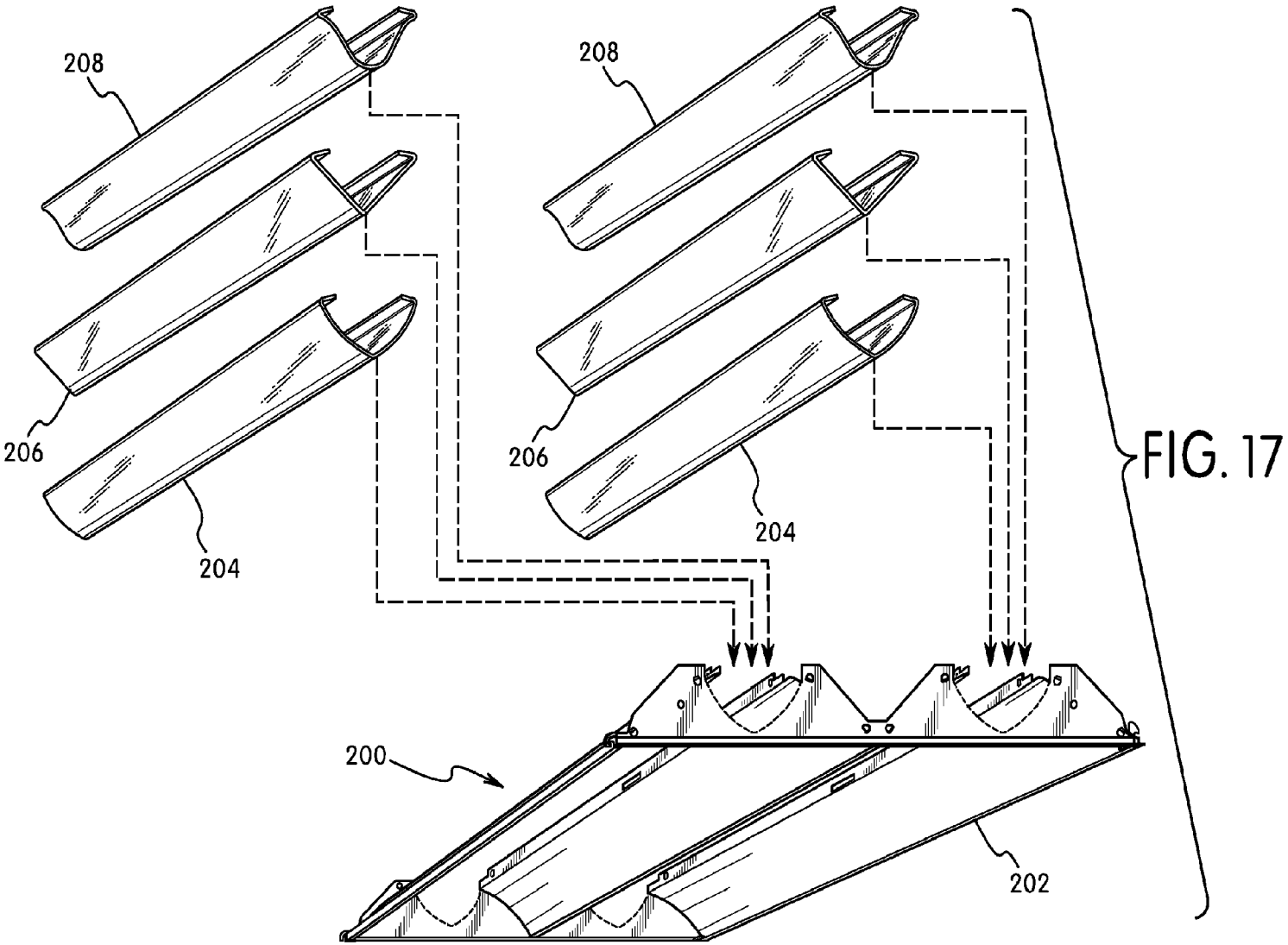
FIG. 17 is a perspective view of the lens kit assembly showing the lens body and three lenses for assembling with the lens body.

In another embodiment of the invention shown in FIG. 17, a lens assembly kit 200 is provided which includes a lens housing 202 and at least two lenses, and preferably three lenses 204, 206 and 208 having different shapes. The lens of the desired shape is selected by the user and assembled to the lens housing 202 as in the previous embodiments.

While various embodiments have been chosen to illustrate the invention, it will be understood by those skilled in the art that various changes and modifications can be made without parting from the scope of the invention as defined in the appended claims.

What is claimed is:

1. A lens assembly for directing light emitted from a light source toward a designated area, the lens assembly comprising:

a housing having a first end wall and an opposite second end wall, each of said first and second end walls having a bottom edge and a top edge, said top edge having a recessed area; and a lens having a longitudinal dimension and an outer configuration and outer dimension complimenting said recessed area in said end walls, said lens being received in said recessed areas of said end walls.

2. The lens assembly of claim 1, wherein said lens has a first longitudinal end extending outwardly from said first end wall, and a second longitudinal end extending outwardly from said second end wall.

3. The lens assembly of claim 2, wherein said first end wall has a first stop member and said second end wall has a second stop member, said first and second stop members being positioned to resist longitudinal movement of said lens with respect to said housing and end walls.

4. The lens assembly of claim 3, wherein said first stop member is integrally formed with said first end wall and extends outwardly from said recessed portion, and said second stop member is integrally formed with said second end wall and extends outwardly from said recessed portion.

5. The lens assembly of claim 4, wherein said stop members have a first leg extending in a longitudinal direction with respect to said lens and a second leg extending substantially perpendicular to said first leg.

6. The lens assembly of claim 1, wherein said end walls are substantially parallel to each other and substantially perpendicular to a longitudinal dimension of said lens, and said lens having a first longitudinal end spaced outwardly from said first end wall, and a second longitudinal end spaced outwardly from said second end wall.

7. The lens assembly of claim 6, wherein said recessed areas in said first end wall and second end wall have a first shape, and said lens has a cross-section substantially similar to said first shape of said recessed areas.

8. The lens assembly of claim 6, further comprising a reflector extending between said first and second end walls, said reflector having a bottom edge adjacent the bottom edges of the end walls and a top edge contacting a top end of said lens.

9. The lens assembly of claim 8, further comprising a fastener member coupling said top edge of said reflector to said top edge of said lens.

10. The lens assembly of claim 9, wherein said fastener is a spring clip.

11. The lens assembly of claim 8, wherein said lens has an open top end, a first flange portion and a second flange portion opposite said first flange portion, each said flange portion defining said top end and being coupled to said reflector.

12. A light fixture for directing light toward a designated area, including a main housing supporting a light source for emitting light, a lens assembly hinged to said main housing, said lens assembly comprising:

a body having a first end wall and an opposite second end wall, each of said end walls having a bottom edge and a top edge, each of said top edges having a recessed area; and a lens having a longitudinal dimension and an outer configuration and dimension complementing said recessed area in said end walls, and said lens being received in recessed areas and supported by said end walls.

13. The light fixture of claim 12, wherein said lens has a longitudinal dimension greater that a spacing between said end walls, and where said lens has first longitudinal end spaced outwardly from said first end wall and a second longitudinal end spaced outwardly for said second wall.

14. The light fixture of claim 13, wherein said first end wall has a first stop member and said second end wall has a second stop member, said first and second stop members being positioned to prevent longitudinal movement of said lens with respect to said end walls.

15. The light fixture of claim 14, wherein said first stop member is integrally formed with said first end wall and extends outwardly form said recessed portion, and said second stop member is integrally formed with said second end wall and extends outwardly from said recessed portion.

16. The light fixture of claim 15, wherein each of said stop members have a first leg extending outwardly from the respective end wall in a longitudinal direction with respect to said lens, and a second leg extending substantially perpendicular to said first leg.

17. The light fixture of claim 12, wherein said end walls are substantially parallel to each other and substantially perpendicular to a longitudinal dimension of said housing.

18. The light fixture of claim 17, wherein said recessed areas in said top edge of said first end wall and said second wall have a first shape, and said lens has a cross-section substantially similar to said first shape of said recessed areas.

19. The light fixture of claim 17, further comprising a first reflector and a second reflector, each said reflector having a bottom edge adjacent the bottom edges of said side walls and a top edge contacting a top end of said lens.

20. The light fixture of claim 19, wherein said lens has an open top end with a first top edge contacting said top edge of said first reflector and a second top edge contacting said top edge of said second reflector.

21. The light fixture of claim 20, wherein said lens has a first inwardly extending flange defining said first top edge, said first flange being coupled to the top edge of said first reflector, and a second inwardly extending flange defining said second top edge of said lens, said second flange being coupled to the top edge of said second reflector.

22. The light fixture of claim 21, further comprising a first fastener member coupling said first flange to said top edge of said first reflector, and a second fastener member coupling said second flange to said top edge of said second reflector.

23. The light fixture of claim 22, wherein said fastener members are spring clips.

24. A lighting assembly for directing light toward a designated area, the assembly comprising:

a main housing supporting a lamp, said housing having opposite side walls and opposite end walls, said lamp extending between said opposite end walls; and a lens assembly hinged to said main housing, said lens assembly comprising:

a first end wall having a bottom edge and a top edge with a recessed area;

a second end wall having a bottom edge and a top edge with a recessed area;

a lens having a longitudinal dimension with an open top end and being received in said recessed areas and supported by said end walls;

a first reflector extending between and coupled to said end walls, said first reflector having a top end coupled to a first edge of said top end of said lens; and a second reflector extending between and being coupled to said end walls, said second reflector having a top end coupled to a second edge of said top end of said lens, said second reflector being positioned on side of said lens opposite said first reflector.

25. The lighting assembly of claim 24, wherein said lens includes a first flange extending inwardly from said first top edge of said lens and being coupled to said first reflector, and a second flange extending inwardly from said second top edge of said lens and being coupled to said second reflector.

26. The lighting assembly of claim 24, wherein each of said end walls include a stop member extending from said recessed area of said end walls to prevent longitudinal movement of said lens with respect to said lens assembly.

27. The lighting assembly of claim 26, wherein said recessed area of said first and second end walls has a pair of edges, and where each of said edges include a stop member to prevent longitudinal movement of said lens.

28. A lighting fixture and lens assembly for directing light emitted from a light source, the lens assembly comprising:

a first end wall and a second end wall opposite said first end wall;

a first reflector having a longitudinal dimension with a first end coupled to said first end wall by a fastener, and a second end coupled to said second end wall by a fastener;

a second reflector having a longitudinal dimension with a first end coupled to said first end wall and a second end coupled to said second end wall by a fastener, said second reflector being oriented in a direction substantially parallel to said first reflector and said second reflector being spaced from said first reflector to form a longitudinally extending opening between said first and second reflectors; and a lens having a longitudinal dimension greater than the longitudinal dimension of said first and second reflectors and being received in said opening.

29. The lighting fixture and lens assembly of claim 28, wherein said first end wall and second end wall have a recessed portion aligned with said opening, and where said lens is received in said recessed portions.

30. The lighting fixture and lens assembly of claim 29, wherein said lens has a shape corresponding to a shape of said recessed portions.

31. A lens assembly kit for a lighting fixture, comprising:

a housing having a first end wall and an opposite end wall, a first reflector extending between said first and second end walls, and a second reflector extending between said first and second end walls and being spaced from said first reflector to define a longitudinal opening;

a first lens having a dimension corresponding to a dimension of said opening and having a first shape; and a second lens having a dimension corresponding to a dimension of said opening and having a second shape that is different from said first shape.

32. The lens assembly kit of claim 31, further comprising a third lens having a dimension corresponding to a dimension of said opening and having a third shape that is different from said first shape and second shape.

33. The lens assembly kits of claim 31, wherein said first and second end walls have a recessed area aligned with the opening and having a dimension to received at least one of said lenses.

34. The lens assembly kits of claim 32, wherein said first lens has a substantially V-shape with flat panels, said second lens has a substantially V-shape with concave panels, and said third lens has a substantially cyma shape.

* * * * *